US008558774B2

(12) United States Patent
Huang

(10) Patent No.: US 8,558,774 B2
(45) Date of Patent: Oct. 15, 2013

(54) LIQUID CRYSTAL DISPLAY WITH SYMBOL BIT GENERATING CIRCUIT AND DRIVING METHOD THEREOF

(75) Inventor: Shun-Ming Huang, Shenzhen (CN)

(73) Assignees: Innocom Technology (Shenzhen) Co., Ltd., Shenzhen, Guangdong Province (CN); Chimei Innolux Corporation, Chu-Nan, Miao-Li County (TW)

( * ) Notice: Subject to any disclaimer, the term of this patent is extended or adjusted under 35 U.S.C. 154(b) by 1535 days.

(21) Appl. No.: 12/156,570

(22) Filed: Jun. 2, 2008

(65) Prior Publication Data

US 2008/0297524 A1 Dec. 4, 2008

(30) Foreign Application Priority Data

Jun. 1, 2007 (CN) ..... 2007 1 0074801

(51) Int. Cl.
*G09G 3/36* (2006.01)

(52) U.S. Cl.
USPC ..... 345/96; 345/204

(58) Field of Classification Search
USPC ..... 345/204
See application file for complete search history.

(56) References Cited

U.S. PATENT DOCUMENTS 5,438,342 A * 8/1995 Yamaguchi ..... 345/58
7,961,163 B2 * 6/2011 Koo et al. ..... 345/87
2002/0050971 A1 5/2002 Su et al.

* cited by examiner

*Primary Examiner* — Sumati Lefkowitz
*Assistant Examiner* — Joseph Fox
(74) *Attorney, Agent, or Firm* — Muncy, Geissler, Olds & Lowe, PLLC

(57) ABSTRACT

An exemplary liquid crystal display includes a data circuit, a memory, and a timing controller. The data circuit includes a polarity generating circuit. The timing controller includes: a data analysis circuit configured for analyzing video signals stored in the memory and generates a corresponding symbol bit to each datum according to the category of each datum; and a symbol bit generating circuit configured for receiving the video data from the data analysis circuit, and keeping or altering the symbol bit of each datum according to the symbol bit of each datum outputted from the data analysis circuit. The data circuit is configured for receiving the video data having symbol bits from the timing controller. The polarity generating circuit is configured for generating a corresponding polarity control signal according to each of the symbol bits of the video data. A related method for driving the liquid crystal display is also provided.

6 Claims, 5 Drawing Sheets

LIQUID CRYSTAL DISPLAY WITH SYMBOL BIT GENERATING CIRCUIT AND DRIVING METHOD THEREOF

FIELD OF THE INVENTION

The present invention relates to liquid crystal displays (LCDs) and methods for driving LCDs, and particularly to an LCD with a symbol bit generating circuit and a method for driving such LCD.

GENERAL BACKGROUND

An LCD utilizes liquid crystal molecules to control light transmissivity of each of pixel unit regions thereof. The liquid crystal molecules are driven according to external video signals received by the LCD. A conventional LCD generally employs a selected one of a frame inversion driving method, a line inversion driving method, a 1-line dot inversion driving method, and a 2-line dot inversion driving method to drive the liquid crystal molecules. Each of these driving methods can protect the liquid crystal molecules from decay or damage.

FIG. 7 is essentially an abbreviated circuit diagram of a conventional LCD. The LCD 100 includes a liquid crystal panel 10, a timing controller 101, a scanning circuit 102, a data circuit 103, and a common voltage generating circuit (not shown). The scanning circuit 102, the data circuit 103, and the common voltage generating circuit are configured for driving the liquid crystal panel 10.

The liquid crystal panel 10 includes a plurality of parallel scanning lines G1~Gn, a plurality of parallel data lines D1~Dm orthogonal to the scanning lines G1~Gn, and a plurality of pixel units 130 cooperatively defined by the crossing scanning lines G1~Gn and data lines D1~Dm. The scanning lines G1~Gn are electrically coupled to the scanning circuit 102, and the data lines D1~Dm are electrically coupled to the data circuit 103.

Each pixel unit 130 includes a thin film transistor Qab (where a and b are natural numbers, $1 \le a \le n$, $1 \le b \le m$) and a liquid crystal capacitor Ccd (where c and d are natural numbers, $1 \le c \le n$, $1 \le d \le m$). The thin film transistor Qab is disposed near an intersection of a corresponding one of the scanning lines G1~Gn and a corresponding one of the data lines D1~Dm. A gate electrode of the thin film transistor Qab is electrically coupled to the corresponding one of the scanning lines G1~Gn, and a source electrode of the thin film transistor Qab is electrically coupled to the corresponding one of the data lines D1~Dm. Further, a drain electrode of the thin film transistor Qab is electrically coupled to the liquid crystal capacitor Ccd.

The scanning circuit 102 outputs a plurality of scanning signals to scan the plurality of scanning lines G1~Gn successively. For example, when the scanning line G1 is scanned, the thin film transistors Q11~Q1*m* are turned on simultaneously. Then the data circuit 103 outputs data signals to the liquid crystal capacitors C11~C1*m* via the data lines D1~Dm and corresponding thin film transistors Q11~Q1*m*. The common voltage generating circuit outputs common voltages to the liquid crystal capacitors C11~C1*m*. After all the scanning lines G1~Gn have been scanned in a single frame period, the aggregation of light transmitting through the respective pixel units 130 constitutes the display of an image on the liquid crystal panel 10.

The data signals applied to each liquid crystal capacitor Ccd include positive polarity data signals (+) and negative polarity data signals (−). A value of each positive polarity data signal is greater than that of the common voltage, and a value of each negative polarity data signal is less than that of the common voltage. When an absolute value of a difference between the positive polarity data signal and the common voltage of any one pixel unit 130 is equal to an absolute value of a difference between the negative polarity data signal and the common voltage of any other pixel unit 130, the two pixel units 130 display picture elements having a same gray level.

FIG. 8 is a diagram illustrating a principle of the 1-line dot inversion driving method. In order to simplify the following explanation, FIG. 8 only shows a 4-by-4 sub-matrix of pixel units 130 of the liquid crystal panel 10. The other pixel units 130 of the liquid crystal panel 10 have a polarity arrangement similar to that shown in FIG. 8. The polarity of each pixel unit 130 in FIG. 8 is opposite to the polarity of every directly adjacent pixel unit 130, and the polarity of each pixel unit 130 is reversed once in every frame period. When a 1-line dot inversion test pattern as shown in FIG. 9 is applied to the liquid crystal panel 10, the pixel units 130 arranged along oblique lines in the sub-matrix are in dark states, and the other pixel units 130 in the sub-matrix are in bright states.

Referring to FIG. 10, this illustrates an operation principle of displaying the 1-line dot inversion test pattern of FIG. 9 on the LCD 100 using the 1-line dot inversion driving method. The pixel units 130 marked with circles all have positive polarities during an $(n-1)^{th}$ frame period, negative polarities during an $n^{th}$ frame period, and positive polarities again during an $(n+1)^{th}$ frame period. Because the common voltage of the liquid crystal panel 10 may shift slightly when the polarity of each pixel unit 130 is changed, the pixel units 130 displaying the same gray level but having opposite polarities may have different charging conditions. Accordingly, when the polarities of all the pixel units 130 in bright states displaying a same gray level are inverted at the same time, the corresponding image viewed by a user may flicker.

What is needed, therefore, is an LCD and a driving method for the LCD which can overcome the above-described deficiencies.

SUMMARY

A liquid crystal display includes a data circuit, a memory, and a timing controller. The data circuit includes a polarity generating circuit. The timing controller includes: a data analysis circuit configured for analyzing video signals stored in the memory and generates a corresponding symbol bit to each datum according to the category of each datum; and a symbol bit generating circuit configured for receiving the video data from the data analysis circuit, and keeping or altering the symbol bit of each datum according to the symbol bit of each datum outputted from the data analysis circuit. The data circuit is configured for receiving the video data having symbol bits from the timing controller. The polarity generating circuit is configured for generating a corresponding polarity control signal according to each of the symbol bits of the video data.

A driving method for a liquid crystal display includes: providing a liquid crystal display comprising a data circuit comprising a polarity generating circuit, a memory, and a timing controller, the timing controller comprising a data analysis circuit and a symbol bit generating circuit; receiving external video data and writing the video data to the memory by the timing controller; reading the video data from the memory by the data analysis circuit; analyzing the video data and generating a corresponding symbol bit to each video datum according to the category of each video datum by the data analysis circuit; receiving the video data from the data analysis circuit and keeping or altering the symbol bit of each video datum according to the symbol bit of each video datum outputted from the data analysis circuit by the symbol bit generating circuit; and receiving the video data having symbol bits from the timing controller by the data circuit; and generating a corresponding polarity control signal according to each of the symbol bits of the video data by the polarity generating circuit.

Other novel features and advantages will become more apparent from the following detailed description when taken in conjunction with the accompanying drawings.

DETAILED DESCRIPTION OF PREFERRED EMBODIMENTS

Reference will now be made to the drawings to describe preferred and exemplary embodiments in detail.

Figure 1:
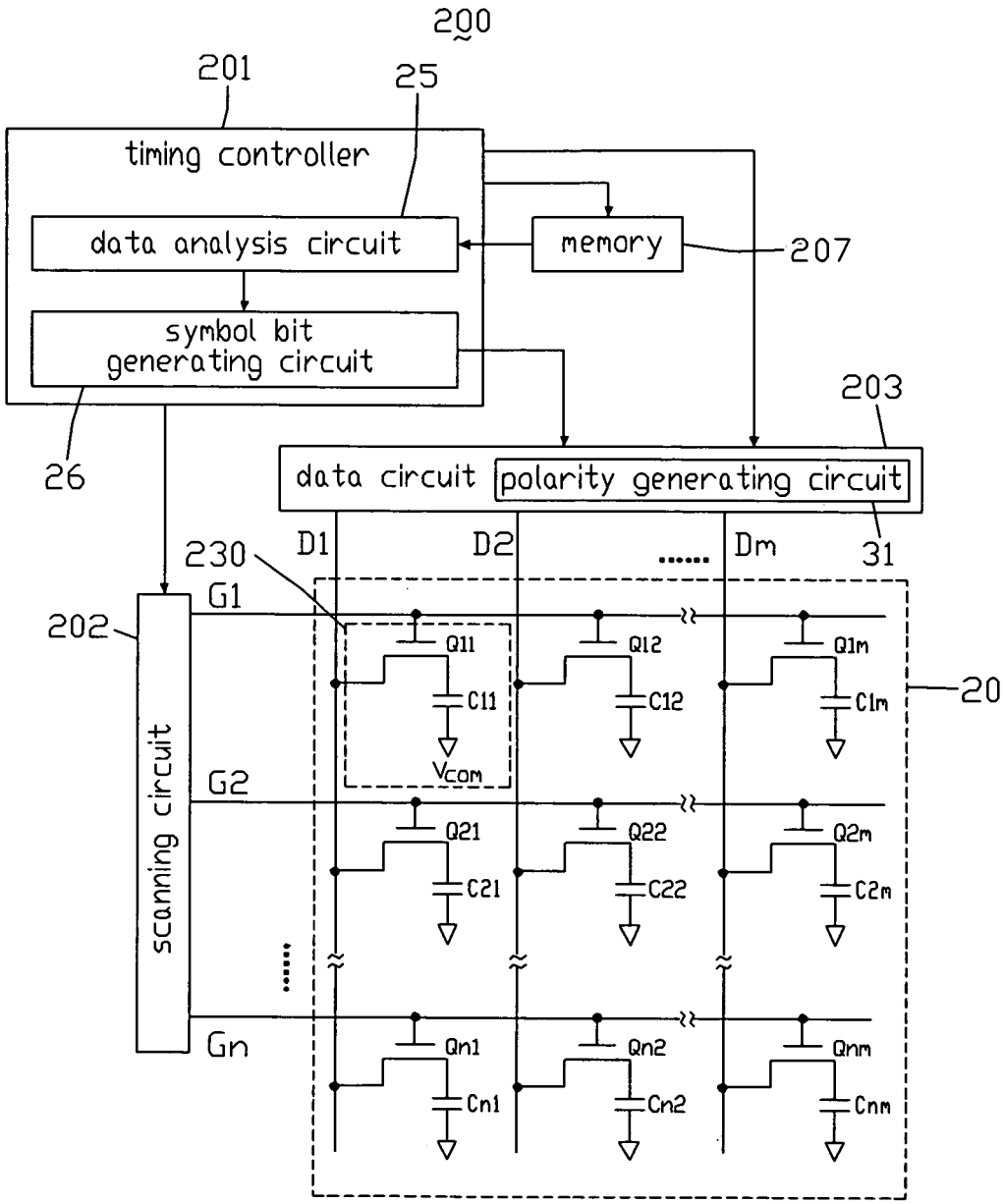
FIG. 1 is essentially an abbreviated circuit diagram of an LCD according to an exemplary embodiment of the present invention, the LCD including a data analysis circuit, a symbol bit generating circuit, and a polarity generating circuit.

FIG. 1 is essentially an abbreviated circuit diagram of an LCD according to an exemplary embodiment of the present invention. The LCD 200 includes a liquid crystal panel 20, a timing controller 201, a scanning circuit 202, a data circuit 203, a memory 207, and a common voltage generating circuit (not shown). The timing controller 201 includes a data analysis circuit 25 and a symbol bit generating circuit 26. The data circuit 203 includes a polarity generating circuit 31. The scanning circuit 202, the data circuit 203, and the common voltage generating circuit are configured for driving the liquid crystal panel 20.

The liquid crystal panel 20 includes a plurality of parallel scanning lines G1~Gn, a plurality of parallel data lines D1~Dm orthogonal to the scanning lines G1~Gn, and a plurality of pixel units 230 cooperatively defined by the crossing scanning lines G1~Gn and data lines D1~Dm. The scanning lines G1~Gn are electrically coupled to the scanning circuit 202, and the data lines D1~Dm are electrically coupled to the data circuit 203.

Each pixel unit 230 includes a thin film transistor Qab (where a and b are natural numbers, $1 \le a \le n$, $1 \le b \le m$) and a liquid crystal capacitor Ccd (where c and d are natural numbers, $1 \le c \le n$, $1 \le d \le m$). The thin film transistor Qab is disposed near an intersection of a corresponding one of the scanning lines G1~Gn and a corresponding one of the data lines D1~Dm. A gate electrode of the thin film transistor Qab is electrically coupled to the corresponding one of the scanning lines G1~Gn, and a source electrode of the thin film transistor Qab is electrically coupled to the corresponding one of the data lines D1~Dm. Further, a drain electrode of the thin film transistor Qab is electrically coupled to the liquid crystal capacitor Ccd.

The timing controller 201 receives external video signals and writes the video signals into the memory 207. The scanning circuit 202 outputs a plurality of scanning signals to scan the plurality of scanning lines G1~Gn successively. For example, when the scanning line G1 is scanned, the thin film transistors Q11~Q1*m* are turned on simultaneously. Then the data circuit 203 outputs data signals to the liquid crystal capacitors C11~C1*m* via the data lines D1~Dm and corresponding thin film transistors Q11~Q1*m*. The common voltage generating circuit outputs common voltages to the liquid crystal capacitors C11~C1*m*. After all the scanning lines G1~Gn have been scanned in a single frame period, the aggregation of light transmitting through the respective pixel units 230 constitutes the display of an image on the liquid crystal panel 20.

The video signals stored in the memory 207 include a plurality of data, and each item of the data (i.e. datum) corresponds to one picture element displayed by one of the plurality of pixel units 230. The plurality of data can be categorized into bright data and dark data. The bright data are configured to make the pixel units 230 display picture elements in bright states, and the dark data are configured to make the pixel units 230 display picture elements in dark states. The bright states and the dark states are defined relative to each other. For example, when the data signal applied to each of the pixel units 230 is greater than or equal to the $127^{th}$ gray level, the picture element displayed by the pixel unit 230 is defined as being in the bright state. When the data signal applied to each of the pixel units 230 is less than the $127^{th}$ gray level, the picture element displayed by the pixel unit 230 is defined as being in the dark state.

The data analysis circuit 25 reads the video signals stored in the memory 207, determines the bright/dark state category of each datum, and generates a symbol bit corresponding to each datum according to the category of the datum. The symbol bit generating circuit 26 receives the data from the data analysis circuit 25, and maintains or alters a previously recorded symbol bit of each datum according to the symbol bit of each datum outputted from the data analysis circuit 25. The data circuit 203 receives the data having symbol bits from the timing controller 201. The polarity generating circuit 31 generates a corresponding polarity control signal according to each of the symbol bits of the data.

Figure 2:
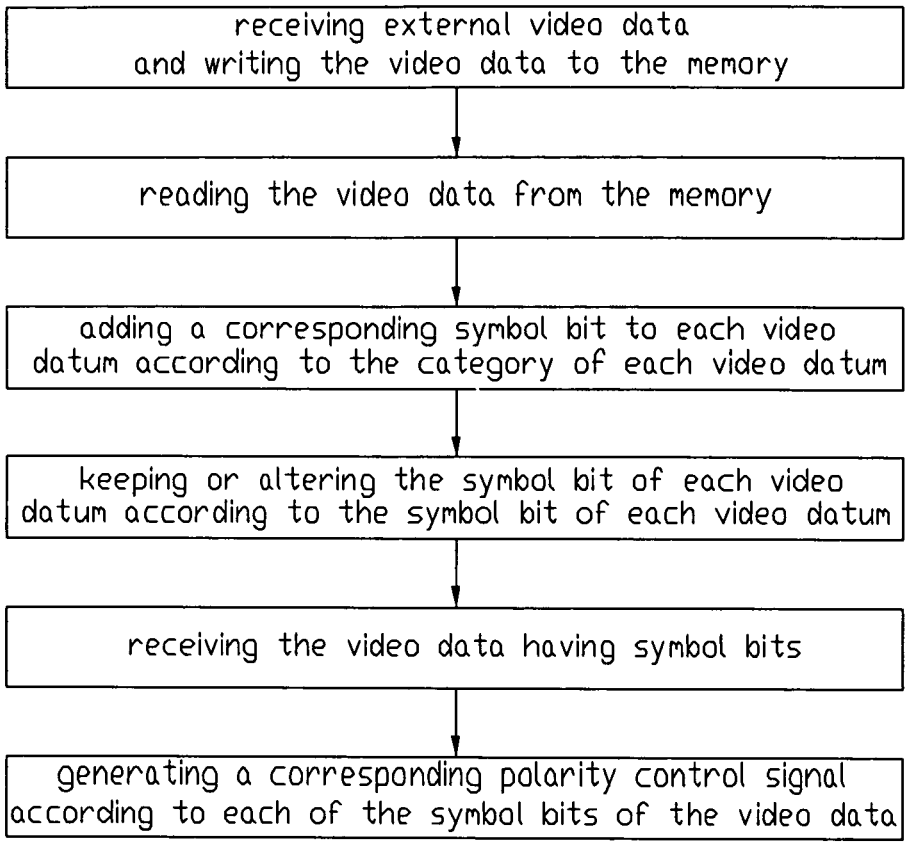
FIG. 2 is a flow chart summarizing an exemplary method for driving the LCD of FIG. 1.
Figure 3:
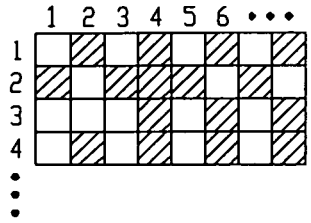
FIG. 3 is an abbreviated diagram of a random test pattern.
Figure 4:
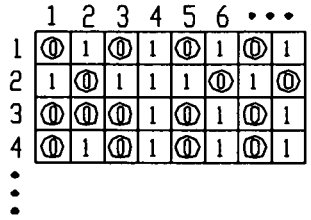
FIG. 4 is an abbreviated diagram illustrating symbol bits of data corresponding to the picture elements of FIG. 3 outputted from the data analysis circuit of the LCD of FIG. 1.

FIG. 3 is an abbreviated diagram of a random test pattern. The test pattern includes 1280*1024 picture elements arranged in a matrix having 1280 columns and 1024 rows. When the random test pattern is applied to the liquid crystal panel 20, the picture elements arranged along oblique lines are in dark states, and the other picture elements are in bright states. Referring to FIG. 4, this illustrates an operation principle of displaying the random test pattern on the liquid crystal panel 20 using a driving method according to an exemplary embodiment of the present invention. The exemplary driving method used to display the random test pattern is described below:

FIG. 2 is a flow chart summarizing the exemplary driving method. Firstly, the timing controller 201 receives external video signals corresponding to the random test pattern of FIG. 3. Then the video signals are written into the memory 207. The video signals stored in the memory 207 include 1,310,720 data, with each item of the data (i.e. datum) corresponding to one of the picture elements of the random test pattern. The 1,310,720 data can be classified into 1024 groups corresponding to the 1024 rows of picture elements of the random test pattern. For example, the $1^{st}$ datum to the $1280^{th}$ datum belong to the first group, with the first group corresponding to the first row of picture elements of the random test pattern. The $1281^{st}$ datum to the $2560^{th}$ datum belong to the second group, with the second group corresponding to the second row of picture elements of the random test pattern.

The data analysis circuit 25 reads the video signals from the memory 207 and analyzes the 1,310,720 data one by one. When a datum is a bright datum, the data analysis circuit 25 generates a symbol bit 0 assigned to the datum. When a datum is a dark datum, the data analysis circuit 25 generates a symbol bit 1 assigned to the datum. For example, when the first datum is a bright datum, the data analysis circuit 25 generates a symbol bit 0 assigned to the first datum. When the second datum is a dark datum, the data analysis circuit 25 generates a symbol bit 1 assigned to the second datum. In FIG. 4, all the bright data picture elements are labeled with circles.

Figure 5:
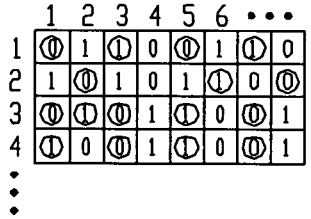
FIG. 5 is an abbreviated diagram illustrating symbol bits of the data corresponding to the picture elements of FIG. 3 outputted from the symbol bit generating circuit of the LCD of FIG. 1.

The symbol bit generating circuit 26 receives the 1,310,720 data having symbol bits from the data analysis circuit 25, and analyzes them group by group. Each group of the data having symbol bits corresponds to a respective row of the picture elements. For each group of the data having symbol bits, when the symbol bit of a datum outputted from the data analysis circuit 25 is 0 (i.e. the datum is a bright datum), the symbol bit generating circuit 26 maintains the symbol bit as 0 if the symbol bit of the corresponding previous adjacent bright datum is 1; and the symbol bit generating circuit 26 alters the symbol bit to be 1 if the symbol bit of the corresponding previous adjacent bright datum is 0. When the symbol bit of a datum outputted from the data analysis circuit 25 is 1 (i.e. the datum is a dark datum), the symbol bit generating circuit 26 maintains the symbol bit as 1 if the symbol bit of the corresponding previous adjacent bright datum is 0; and the symbol bit generating circuit 26 alters the symbol bit to be 0 if the symbol bit of the corresponding previous adjacent bright datum is 1, as shown in FIGS. 4 and 5.

In particular, for the first group of the data having symbol bits, the symbol bit of the first datum outputted from the data analysis circuit 25 is 0, and the symbol bit generating circuit 26 keeps the symbol bit as 0. The symbol bit of the second datum outputted from the data analysis circuit 25 is 1 and the symbol bit of the first datum is 0, so the symbol bit generating circuit 26 keeps the symbol bit as 1. The symbol bit of the third datum outputted from the data analysis circuit 25 is 0 and the symbol bit of the first datum is 0, so the symbol bit generating circuit 26 alters the symbol bit to be 1. The symbol bit of the fourth datum outputted from the data analysis circuit 25 is 1 and the up-to-date symbol bit of the third datum is 1, so the symbol bit generating circuit 26 alters the symbol bit to be 0. The symbol bit of the fifth datum outputted from the data analysis circuit 25 is 0 and the symbol bit of the third datum is 1, so the symbol bit generating circuit 26 keeps the symbol bit as 0. The symbol bit of the sixth datum outputted from the data analysis circuit 25 is 1 and the symbol bit of the fifth datum is 0, the symbol bit generating circuit 26 keeps the symbol bit as 1. The symbol bit of the seventh datum outputted from the data analysis circuit 25 is 0 and the symbol bit of the fifth datum is 0, so the symbol bit generating circuit 26 changes the symbol bit as 1.

For the second group, the symbol bit of the $1281^{st}$ datum outputted from the data analysis circuit 25 is 1 and the symbol bit of the first datum is 0, the symbol bit generating circuit 26 keeps the symbol bit as 1. The symbol bit of the $1282^{nd}$ datum outputted from the data analysis circuit 25 is 0 and the symbol bit of the $1281^{st}$ datum is 1, the symbol bit generating circuit 26 keeps the symbol bit as 0. The symbol bit of the $1283^{rd}$ datum outputted from the data analysis circuit 25 is 1 and the symbol bit of the $1282^{nd}$ datum is 0, the symbol bit generating circuit 26 keeps the symbol bit as 1. The symbol bit of the $1284^{th}$ datum outputted from the data analysis circuit 25 is 1 and the symbol bit of the $1283^{rd}$ datum is 1, the symbol bit generating circuit 26 alters the symbol bit to be 0. The symbol bit of the $1285^{th}$ datum outputted from the data analysis circuit 25 is 1 and the symbol bit of the $1284^{th}$ datum is 0, the symbol bit generating circuit 26 keeps the symbol bit as 1. The symbol bit of the $1286^{th}$ datum outputted from the data analysis circuit 25 is 0 and the symbol bit of the $1282^{nd}$ datum is 0, the symbol bit generating circuit 26 alters the symbol bit to be 1. The symbol bit of the $1287^{th}$ datum outputted from the data analysis circuit 25 is 1 and the symbol bit of the $1286^{th}$ datum is 1, the symbol bit generating circuit 26 alters the symbol bit to be 0.

For the third group, the symbol bit of the $2561^{st}$ datum outputted from the data analysis circuit 25 is 0 and the symbol bit of the $1281^{st}$ datum is 1, the symbol bit generating circuit 26 keeps the symbol bit as 0. The symbol bit of the $2562^{nd}$ datum outputted from the data analysis circuit 25 is 0 and the symbol bit of the $2561^{st}$ datum is 0, the symbol bit generating circuit 26 alters the symbol bit to be 1. The symbol bit of the $2563^{rd}$ datum outputted from the data analysis circuit 25 is 0 and the symbol bit of the $2562^{nd}$ datum is 1, the symbol bit generating circuit 26 keeps the symbol bit as 0. The symbol bit of the $2564^{th}$ datum outputted from the data analysis circuit 25 is 1 and the symbol bit of the $2563^{rd}$ datum is 0, the symbol bit generating circuit 26 keeps the symbol bit as 1. The symbol bit of the $2565^{th}$ datum outputted from the data analysis circuit 25 is 0 and the symbol bit of the $2563^{rd}$ datum is 0, the symbol bit generating circuit 26 alters the symbol bit to be 1. The symbol bit of the $2566^{th}$ datum outputted from the data analysis circuit 25 is 1 and the symbol bit of the $2565^{th}$ datum is 1, the symbol bit generating circuit 26 alters the symbol bit to be 0. The symbol bit of the $2567^{th}$ datum outputted from the data analysis circuit 25 is 0 and the symbol bit of the $2565^{th}$ datum is 1, the symbol bit generating circuit 26 keeps the symbol bit as 0.

The data circuit 203 receives the 1,310,720 data having symbol bits from the timing controller 201. The polarity generating circuit 31 generates a positive polarity control signal "+" when the symbol bit of the datum is 0, and generates a negative polarity control signal "−" when the symbol bit of the datum is 1. For example, the polarity generating circuit 31 generates the positive polarity control signal "+" according to the symbol bit (0) of the first datum, and the polarity generating circuit 31 generates the negative polarity control signal "−" according to the symbol bit (1) of the second datum, as shown in FIG. 6.

Figure 6:
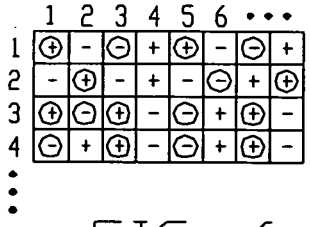
FIG. 6 is an abbreviated diagram illustrating polarities of the data corresponding to the picture elements of FIG. 3 outputted from the polarity generating circuit of the LCD of FIG. 1.
Figure 7:
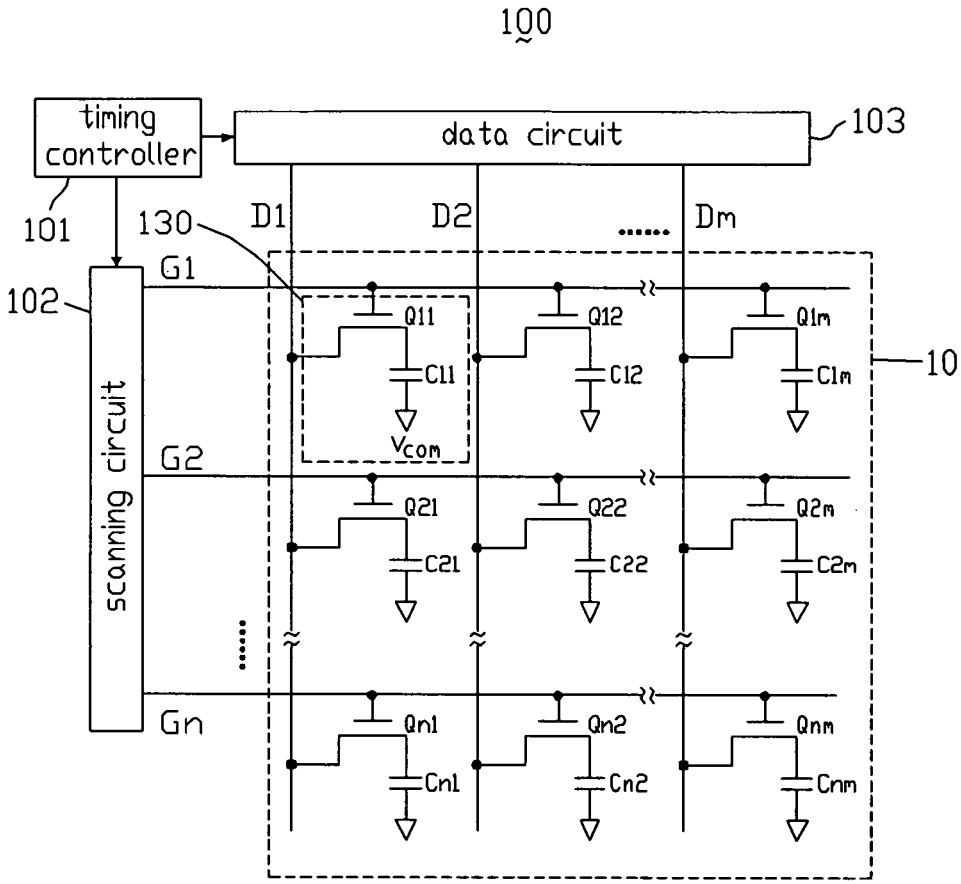
FIG. 7 (RELATED ART)
FIG. 7 is essentially an abbreviated circuit diagram of a conventional LCD.
Figure 8:
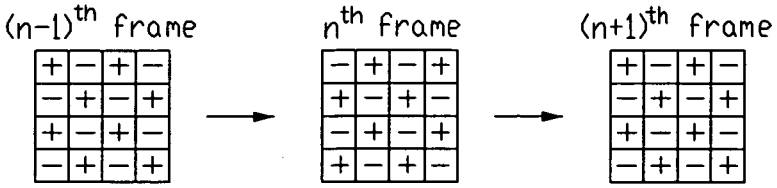
FIG. 8 (RELATED ART)
FIG. 8 is a diagram illustrating a principle of a conventional 1-line dot inversion driving method.
Figure 9:
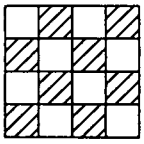
FIG. 9 (RELATED ART)
FIG. 9 is a diagram of a conventional 1-line dot inversion test pattern.
Figure 10:
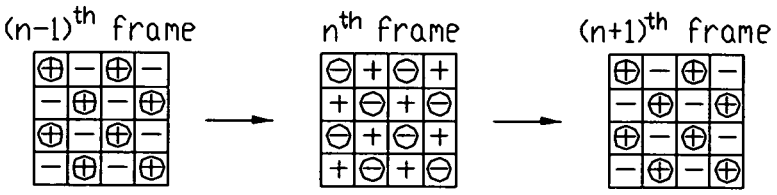
FIG. 10 (RELATED ART)
FIG. 10 is a diagram illustrating an operation principle of displaying the 1-line dot inversion test pattern of FIG. 9 on the LCD of FIG. 7, when using the conventional 1-line dot inversion driving method.

In FIG. 6, a horizontal refresh frequency is assumed as Fh, and a vertical refresh frequency is assumed as Fv. The numbers of the picture elements between the two adjacent picture elements having the same polarity in the same row is not greater than 40, thus, an average polarity change frequency of all the picture elements in bright states in any row is greater than 100Fh. The numbers of the picture elements between the two adjacent picture elements having the same polarity in the same column is not greater than 100, thus, an average polarity change frequency of all the picture elements in bright states in any column is greater than 10Fv.

When the polarity change frequency of all the picture elements in bright states in any row is greater than 100Fh, and the polarity change frequency of all the picture elements in bright states in any column is greater than 10Fv, flickers cannot be observed by human eyes. Thus, flickers cannot be observed by human eyes when the LCD 200 displays the test pattern of FIG. 3.

When flicker is just observed by human eye, a corresponding horizontal refresh frequency is defined as a horizontal flicker frequency, and a corresponding vertical refresh frequency is defined as a vertical flicker frequency. When the LCD 200 is used to display any pattern, the polarity change frequency of all the picture elements in bright states in any row is greater than the horizontal flicker frequency, and the polarity change frequency of all the picture elements in bright states in any column is greater than the vertical flicker frequency. Thus, flickers will not be observed by human eyes.

It is to be further understood that even though numerous characteristics and advantages of the present embodiments have been set out in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A liquid crystal display, comprising:

a memory;

a liquid crystal panel including a plurality of pixel units arrayed in a matrix;

a data analysis circuit configured for analyzing video data and generating a corresponding symbol bit to each video datum according to a category of each datum, each of the video data corresponding to a picture element displayed by one of the pixel units, the video data being categorized into bright data when the corresponding picture elements are in bright states, and dark data when the corresponding picture elements are in dark states;

a symbol bit generating circuit configured for receiving the video data from the data analysis circuit, and keeping or altering the symbol bit of the video datum according to the symbol bit of the video datum outputted from the data analysis circuit; and a data circuit configured for receiving the video data having symbol bits from the symbol bit generating circuit, comprising a polarity generating circuit configured for generating a corresponding polarity control signal according to the symbol bit of the video datum;

wherein the data analysis circuit generates a symbol bit equal to a first value to the video datum when the video datum is a bright datum, and generates a symbol bit equal to a second value to the video datum when the video datum is a dark datum, wherein the symbol bit generating circuit analyzes the video data having symbol bits from the data analysis circuit group, for each group, when the symbol bit of the datum outputted from the data analysis circuit is equal to the first value, the symbol bit generating circuit keeps the symbol bit as equal to the first value when the symbol bit of the adjacent bright datum is equal to the second value, and the symbol bit generating circuit alters the symbol bit to be equal to the second value when the symbol bit of the adjacent bright datum is equal to the first value, and wherein, when the symbol bit of the datum outputted from the data analysis circuit is equal to the second value, the symbol bit generating circuit keeps the symbol bit as equal to the second value when the symbol bit of the adjacent bright datum is equal to the first value, and the symbol bit generating circuit alters the symbol bit to be equal to the first value when the symbol bit of the adjacent bright datum is equal to the second value.

2. The liquid crystal display of claim 1, wherein the polarity generating circuit generates a positive polarity control signal when the symbol bit of the datum is equal to the first value, and generates a negative polarity control signal when the symbol bit of the datum is equal to the second value.

3. The liquid crystal display of claim 1, wherein the memory is configured for storing the video data.

4. A driving method for a liquid crystal display, the driving method comprising:

providing a liquid crystal display comprising a data analysis circuit, a symbol bit generating circuit, a data circuit comprising a polarity generating circuit, and a liquid crystal panel that includes a plurality of pixel units arrayed in a matrix;

analyzing video data and generating a corresponding symbol bit to each video datum according to the category of each video datum by the data analysis circuit, each of the video data corresponding to a picture element displayed by one of the pixel units, the video data being categorized into bright data when the corresponding picture elements are in bright states, and dark data when the corresponding picture elements are in dark states;

receiving the video data from the data analysis circuit and keeping or altering the symbol bit of the video datum according to the symbol bit of the video datum outputted from the data analysis circuit by the symbol bit generating circuit;

receiving the video data having symbol bits from the symbol bit generating circuit by the data circuit; and generating a corresponding polarity control signal according to each of the symbol bits of the video data by the polarity generating circuit;

wherein the data analysis circuit generates a symbol bit equal to the first value to the datum when the datum is a bright datum, and generates a symbol bit equal to the second value to the datum when the datum is a dark datum, wherein the symbol bit generating circuit analyzes the video data having symbol bits from the data analysis circuit group by group, for each group, when the symbol bit of the datum outputted from the data analysis circuit is equal to the first value, the symbol bit generating circuit keeps the symbol bit as equal to the first value when the symbol bit of the adjacent bright datum is equal to the second value, and the symbol bit generating circuit alters the symbol bit to be equal to the second value when the symbol bit of the adjacent bright datum is equal to the first value, and wherein, when the symbol bit of the datum outputted from the data analysis circuit is equal to the second value, the symbol bit generating circuit keeps the symbol bit as equal to the second value when the symbol bit of the adjacent bright datum is equal to the first value, and the symbol bit generating circuit alters the symbol bit to be equal to the first value when the symbol bit of the adjacent bright datum is equal to the second value.

5. The driving method of claim 4, wherein the polarity generating circuit generates a positive polarity control signal when the symbol bit of the datum is equal to the first value, and generates a negative polarity control signal when the symbol bit of the datum is equal to the second value.

6. The driving method of claim 4, wherein the liquid crystal display further comprises a memory configured for storing the video data.

* * * * *